United States Patent [19]

Abbott

[11] 4,171,805

[45] Oct. 23, 1979

[54] ROLLABLE HAND HELD EXERCISE DEVICE

[76] Inventor: Thomas L. Abbott, 125 21st St., Fairmont, W. Va. 26554

[21] Appl. No.: 797,908

[22] Filed: May 18, 1977

[51] Int. Cl.[2] ..... A63B 21/00

[52] U.S. Cl. ..... 272/127

[58] Field of Search ..... 272/127, 126, 143, 116, 272/67, 68

[56] References Cited

U.S. PATENT DOCUMENTS

| | | | |
|---|---|---|---|
| 1,824,920 | 9/1931 | Novak | 272/127 |
| 2,303,922 | 12/1942 | Elmquist | 272/127 |
| 2,821,394 | 1/1958 | Barbeau | 272/127 |
| 3,134,590 | 5/1964 | Young | 272/127X |
| 3,403,906 | 10/1968 | Burzenski | 272/127 X |
| 3,752,475 | 8/1973 | Ott | 272/127 X |
| 3,797,824 | 3/1974 | Osbourne | 272/127 |

*Primary Examiner*—Richard C. Pinkham
*Assistant Examiner*—William R. Browne

[57] ABSTRACT

Apparatus for aiding a person during a physical exercise. Two relatively flat guide members are connected together and aligned in a predetermined position for aiding the exercising person according to his physical ability. The guide members are connected together by a link which permits varying angular orientations of the members simultaneously or permits varying the angular orientation of one member with respect to the other member. Two sets of wheels and handles are provided wherein the exercising person holds the handle portions which are located between the two wheels. The wheels are dimensioned to run in channels in the flat guide members and are limited in the amount of movement by U-shaped members inserted into holes in the channels. The exercising person moves his arms in and out to move the wheel assemblies along the guide members. As this is being accomplished, the upper portion of the exercising person's body is moved up and down to provide the force necessary for muscle development. A U-shaped member is used to pivotally connect together the two guide members.

9 Claims, 6 Drawing Figures

ROLLABLE HAND HELD EXERCISE DEVICE

BACKGROUND OF THE INVENTION

1. Field of the Invention

This invention relates, in general, to exercising apparatus and, more specifically, to exercising apparatus which includes hand grips which are moveable with a linear motion along a guide track.

2. Description of the Prior Art

A person wishing to exercise muscles in his body has basically two types of exercises which he may choose to develop the particular muscles desired. In one type of exercise, the muscles are repeatedly used with not much more strain or force than would be accompanied during normal usage of these muscles. An example of this type of exercising would be walking a long distance. The other type of exercise involves the use of an abnormally large amount of strain exerted on the muscle movement. During such exercises, the muscles are required to provide more force than they do normally in the same type of body motion. An example of the latter type of exercising would be weight lifting.

The type of exercising which requires an excessive amount of force upon the muscles during the exercise requires some means for modifying normal movement to produce the necessary strain on the muscles. With many types of conventional exercising and muscle development devices, springs or weights are used to provide the extra strain on the muscles during the body movements. In other types of devices. and in devices suited particularly for home exercises, the extra weight or force is provided by the weight of the exercising persons own body. For example, a person who does chin-ups is using his own body weight to increase the force needed to contract his arms and move his shoulders in a motion which will pull his wrists closer to his body from an overhead position.

Devices which use the exercising persons body weight to provide the extra tension or force on the muscles are numerous. Many such types of devices have been used according to the prior art. It is desirable in all such machines or devices that they be versatile enough to permit the exercising of different muscles of the body by using different attachments or configurations of the exercising machine. Therefore, it is desirable, and it is an object of this invention, to provide exercising apparatus which may be modified easily and conveniently to exercise different muscles of the body to different degrees.

It is another important characteristic of an exercising machine or device that it have the capability of modification to provide the correct amount of exercising force according to the capabilities of the exercising person. Different people, and the same people in different stages of their exercising program, can benefit mostly from the exercise routines when the proper amount of force is applied to the muscles. In this respect, it is also desirable, and it is another object of this invention, to provide exercising apparatus which can be easily and conveniently changed to regulate or limit the amount of force which will be applied to the muscles of the exercising person.

In addition to the foregoing objects, it is also desirable and an object of this invention to provide an exercising machine or device which is inexpensive to manufacture and which is constructed of a minimum of moveable parts, thereby providing trouble-free operation to the user.

SUMMARY OF THE INVENTION

There is disclosed herein a new and useful exercising machine suitable for aiding a person during a physical exercise. The exercising apparatus includes a pair of guide members which are substantially flat for positioning on a horizontal surface. The exercising apparatus also includes a pair of moving wheel assemblies which are constructed and dimensioned to roll along grooves or channels in the guide members. The channels in each guide member contain holes or openings in which a U-shaped member may be placed which will limit the amount of travel of the wheels along the channels. The two guide members are connected together by a member which allows the guide members to be pivoted or moved with respect to each other in such a manner that the angle at which the wheels are guided by the guide members can be changed.

The movement of the wheels along the guide members allows the exercising of certain muscles in the exercising person's body which would not otherwise be exercised by doing conventional push-ups without any means for moving the arms in and out. The U-shaped members which limit the amount of travel of the wheel assemblies along the guide members provide means for adjusting or setting the apparatus to provide the correct amount of force for the particular person exercising. The construction characteristics of the exercising apparatus which allows the guide members to be oriented in different directions provide the means for exercising different muscles in the exercising person's body.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
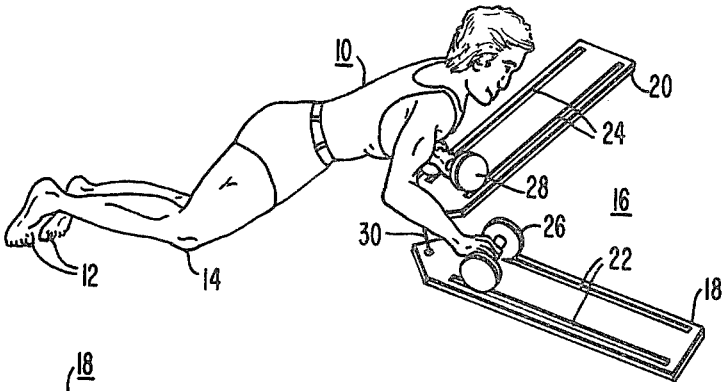
FIG. 1 is a view of a person using the exercising apparatus of this invention.

Throughout the following description, similar reference characters refer to similar elements or members in all of the figures of the drawing.

Referring now to the drawing, and to FIG. 1 in particular, there is shown a person using the exercising apparatus of this invention during an exercise routine. Although other types of exercising routines or positions may be used with the exercising apparatus of this invention, the person 10 is using the apparatus in a position which normally is associated with conventional type push-ups. Some part of the rear portion of the person's body, such as the toes 12 or possibly the knees 14, are resting upon the same surface as the exercising apparatus 16. As the person 10 extends his arms, various movements of the exercising apparatus 16 allow the arms to move up and down and in and out in a manner which exercises the muscles, primarily in the upper portion of the body.

The exercising apparatus 16 shown in FIG. 1 includes a relatively flat guide member 18 and a substantially identical guide member 20. These guide members may be positioned on the floor or other horizontal surface on which the exercise is being performed. The guide members 18 and 20 include tracks or channels 22 and 24, respectively, into which the wheel assemblies 26 and 28 are positioned. The wheel assemblies 26 and 28 allow the arms of the person 10 to move linearly along the guide members 18 and 20 in a direction determined by the exercising person's movements and by the orientation of the guide members of the exercising apparatus 16. In the particular orientation shown in FIG. 1, the guide members are at substantially a 90 degree angle from each other, thereby providing an exercising routine in which the arms are extended both in an upward and outward direction while the person is exercising.

It is emphasized that it is not necessary in order to use the exercising apparatus properly that both arms be extended simultaneously. In other types of exercising routines, it may be desirable to extend one arm at a time, thereby allowing more force to be applied to each arm separately due to the weight of the exercising person's body. Other routines would be obvious to those using the exercising apparatus 16. To accommodate the different routines possible, the guide members 18 and 20 are connected together by a suitable member which permits the guide members to be oriented at different angles.

Figure 2:
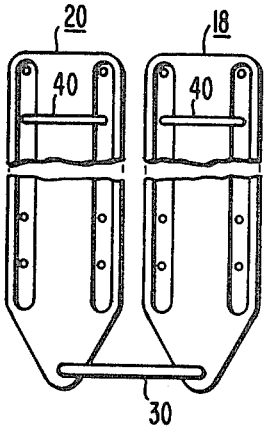
FIG. 2 is a top view of a portion of the exercising apparatus of this invention oriented for one type of exercise.
Figure 3:
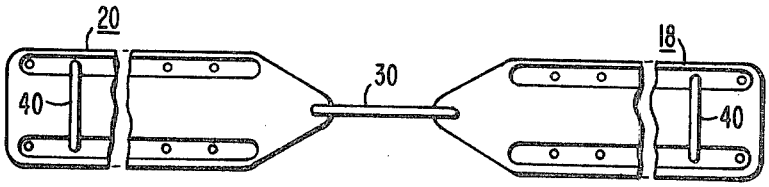
FIG. 3 is a top view of a portion of the exercising apparatus of this invention oriented for another type of exercise.

FIG. 2 is a top view of the guide members of the exercising apparatus shown in an arrangement which would allow the arms to be extended upwardly during the exercise routine. Similarly, FIG. 3 illustrates the orientation of the guide members 18 and 20 which would be used when it is desired to exercise the arms only in inward and outward directions. The U-shaped members 30, as shown in FIGS. 2 and 3, perform the function of keeping the guide members 18 and 20 secured together during the exercise routine.

Figure 4:
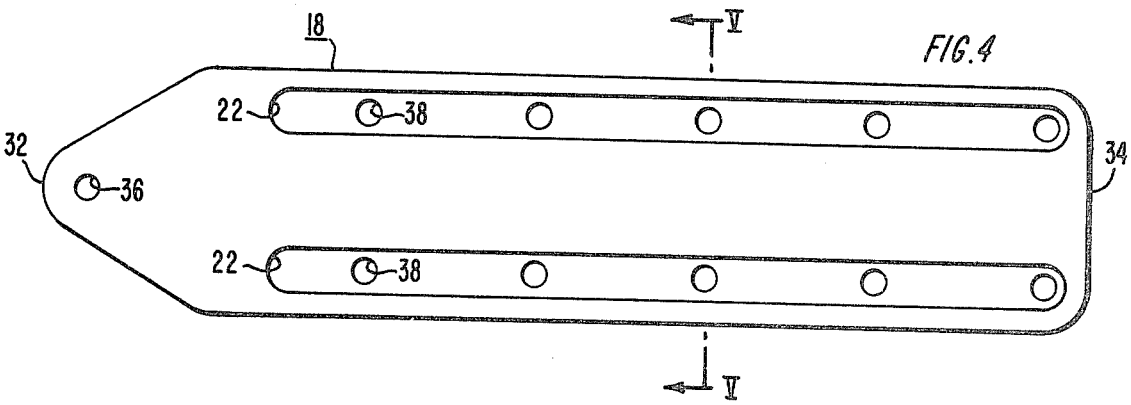
FIG. 4 is a top view of one of the guide members of the exercising apparatus of this invention.
Figure 5:
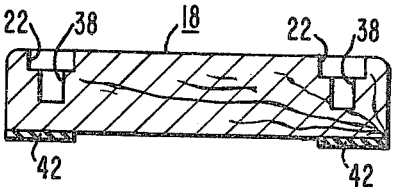
FIG. 5 is a cross-sectional view taken along the line V—V of FIG. 4.

FIG. 4 is a detailed view of the guide member 18 of the exercising apparatus 16. According to this specific embodiment of the invention, the guide member 20 would be constructed identically similar to the guide member 18 as shown in FIG. 4. The tracks or channels 22 are recessed into the upper surface of the guide member 18 and extend in a straight and parallel direction between the first end 32 and the second end 34 of the guide member 18. As shown in FIG. 5, which is a cross-sectional view of the section taken along line V—V of FIG. 4, the channels consist of recessed areas on the upper portion of the guide member 18. The purpose of the channels is to guide the movement of the wheel assembly 26 along the guide member 18. During operation of the exercising apparatus, a portion of each wheel of the wheel assembly 26 is positioned in the track 22. This guides or limits the movement of the wheel assembly 26 along the guide member 18 by the directions permitted by the tracks 22. Therefore, as long as sufficient weight is placed upon the wheel assembly 26 to keep it engaged with the tracks 22, the wheel assembly 26 may only move between ends 32 and 34 with a straight or linear motion.

The opening or hole 36 in the guide member 18 is used for the purpose in securing the U-shaped member 30 as shown in FIGS. 2 and 3, thereby providing means for connecting the guide member 18 to the guide member 20. In addition, the holes 38, as shown in FIGS. 4 and 5, are used for receiving the ends of U-shaped members similar to the member 30 shown in FIGS. 2 and 3. These U-shaped members are used for the purpose of limiting the amount of travel which is possible for the wheel assembly 26 along the guide member 18. In FIGS. 2 and 3, U-shaped members 40 are positioned on the guide members 18 and 20 in such a manner as to restrict the movement of the wheel assemblies and prevent the rolling of the wheel assemblies all the way to the end of the guide members 18 and 20. Depending on the capability of the exercising person and the particular muscles in the body desired to be exercised, the setting or placement of the U-shaped members 40 can be varied to provide the proper amount of exercising, since it requires less force to pull the wheel assemblies in when they are closer to the U-shaped member 30.

The cross-sectional view of FIG. 5 illustrates the use of material or members 42 on the bottom of the guide member 18 which have a high coefficient of friction with surfaces on which the exercising apparatus would normally be used. For example, the member 42 may consist of rubber strips attached to the bottom of the guide member 18 to prevent slipping of the guide member 18 with respect to the horizontal surface during a physical exercise.

Figure 6:
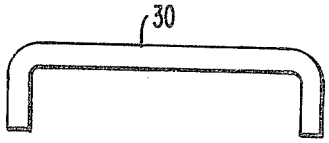
FIG. 6 is a view of the U-shaped member used for limiting the amount of travel possible along the guide members.

FIG. 6 is a view of the U-shaped member 30 which is used to connect together the guide members 18 and 20. The illustration shown in FIG. 6 is also typical of the U-shaped member 40 which may be used to restrict the amount of movement of the wheel assemblies along the guide members.

Figure 7:
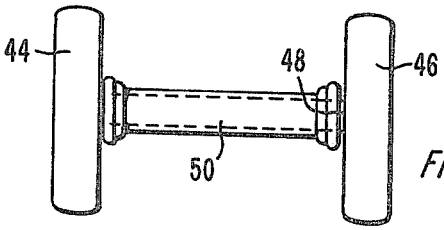
FIG. 7 is a general view of a wheel and handle assembly suitable for use with the guide members of the exercising apparatus.

FIG. 7 is a general view of a wheel assembly which may be used with the guide members of the exercising apparatus. Although other arrangements may be used, the assembly shown in FIG. 7 consists of two wheels, wheels 44 and 46. A sleeve or handle 50 is disposed around the axle 48 and provides means on which the exercising person may grasp the wheel assembly during the exercise routine. Ideally, the handle 50 is free to rotate around the axle 48, thereby permitting rolling movement of the wheel assembly without any tendency to rotate the exercising person's hand. Although other wheel assembly arrangements may be used within the contemplation of this invention, it is a basic requirement for this specific embodiment of the invention that the wheels 44 and 46 be dimensioned to extend down into the tracks or channels 22 of the guide member 18. A similar wheel assembly would be dimensioned to fit in the channels 24 in the guide member 20.

The exercising apparatus of this invention allows the person doing a conventional push-up type of exercise to move his arms in and out and at different angles, both simultaneously and at separate times, for the purpose of exercising other portions and other muscles of the body which would not be exercised using only conventional push-up methods. Other arrangements of the exercising apparatus may be used to perform the objectives of this invention and should be considered as part of the present invention. In addition, since numerous changes may be made in the above described apparatus, and since different embodiments of the invention may be made without parting from the spirit thereof, it is intended that all of the matter contained in the foregoing description, or shown in the accompanying drawing, shall be interpreted as illustrative rather than limiting.

I claim as my invention:

1. An apparatus for aiding a person during physical exercise, said apparatus comprising:

first and second guide members suitable for placement on a generally horizontal surface, and having connecting link means to permit varying angular orientations of both guide members simultaneously or said connecting link means permits one of said guide members to vary its angular orientation with respect to the other one of said guide members;

first and second moving means respectively suitable for movement along said first and second guide members;

each of said guide members including means for defining the motion of said first and second moving means along said guide member;

means for limiting the travel of said moving means along said guide members; and with each of said moving means including two wheels and a handle operatively coupled therebetween for being grasped by the hand of the exercising person, whereby the movement of said moving means along said guide members will guide the exercising motion of the person.

2. Apparatus for aiding a person during a physical exercise, said apparatus comprising;

first and second substantially flat guide members suitable for placement on a flat horizontal surface, said guide members having first and second ends, said first and second guide members each containing two channels which extend generally between said first and second ends;

means for pivotally connecting together the first ends of said first and second guide members;

first and second moving assemblies each including two wheels interconnected by a handle suitable for being grasped by the hand of the exercising person, said wheels being dimensioned to allow the wheels to partially extend into the channels of the flat guide members, thereby permitting the wheels to roll on the guide members in directions defined by the channels.

3. The apparatus of claim 2 wherein the portions of the guide members which define the bottom of the channels contain holes which are substantially equally spaced from the first end of the guide members, and wherein the exercising apparatus also includes U-shaped members which are inserted in said holes to limit the distance the wheels may roll in the channels.

4. An apparatus for aiding a person during a period of physical exercise, said exercising apparatus comprising in combination:

first and second guide members suitable for placement on a generally horizontal surface;

link means for pivotally movably coupling together only adjacent ends of said first and second guide members first and second moving means respectively suitable for movement along said first and second guide members, with each of said guide members including means for defining the motion of said first and second moving means along said guide members; and means for limiting the travel of said moving means along said guide members;

with each of said moving means including a handle for being grasped by the hand of the exercising person, whereby the movement of said moving means along said guide members will guide the exercising motion of the person.

5. The exercising apparatus as described in claim 4 wherein:

said means for defining the motion of said moving means comprises recessed tracks in each of said guide members; and wherein each of said moving means further includes wheels operatively coupled to said handle for communicating within and for being guided by said recessed tracks.

6. An apparatus for aiding a person during physical exercise, said exercising comprising in combination:

first and second guide members suitable for placement on a generally horizontal surface, and having connecting link means to permit varying angular orientations of both guide members simultaneously or said connecting link means permits one of said guide members to vary angular orientation with respect to the other one of said guide members;

first and second moving means respectively suitable for movement along said first and second guide members;

each of said guide members including means for defining the motion of said first and second moving means along said guide member; and with each of said moving means including two wheels and a handle operatively coupled therebetween for being grasped by the hand of the exercising person, whereby the movement of said moving means along said guide members will guide the exercising motion of the person.

7. The apparatus of claim 6 wherein said guide members include substantially flat surfaces on which said moving means travel.

8. The apparatus of claim 7 wherein said means for defining the motion of said moving means includes recessed tracks in each of said guide members.

9. The apparatus of claim 8 wherein said recessed tracks include openings in the bottom thereof, and wherein said means for limiting the travel of said moving means along said guide member comprises a U-shaped member dimensioned to extend into said openings in each of said recessed tracks.

* * * * *